US012577729B2

(12) United States Patent
Avidan et al.

(10) Patent No.: US 12,577,729 B2
(45) Date of Patent: Mar. 17, 2026

(54) PRESERVATION OF MOISTURE EVAPORATION AND BODY TEMPERATURE REGULATION PROPERTIES ON GARMENTS POST PRINTING

(71) Applicant: Kornit Digital Ltd., Rosh HaAyin (IL)

(72) Inventors: Guy Avidan, Zichron Yaakov (IL); Allon Shimoni, Modiin-Maccabim-Reut (IL); Jacob Mann, Zoran (IL); Omer Kulka, Tel Aviv (IL); Haggai Abbo, Kiryat Ono (IL)

(73) Assignee: Kornit Digital Ltd., Rosh HaAyin (IL)

( * ) Notice: Subject to any disclaimer, the term of this patent is extended or adjusted under 35 U.S.C. 154(b) by 533 days.

(21) Appl. No.: 17/766,244

(22) PCT Filed: Oct. 6, 2020

(86) PCT No.: PCT/IL2020/051080

§ 371 (c)(1),
(2) Date: Apr. 3, 2022

(87) PCT Pub. No.: WO2021/070179

PCT Pub. Date: Apr. 15, 2021

(65) Prior Publication Data

US 2024/0052564 A1 Feb. 15, 2024

Related U.S. Application Data

(60) Provisional application No. 62/911,411, filed on Oct. 7, 2019.

(51) Int. Cl.
*D06P 5/30* (2006.01)
*A41D 31/12* (2019.01)

(52) U.S. Cl.
CPC ..... *D06P 5/30* (2013.01); *A41D 31/125* (2019.02)

(58) Field of Classification Search
CPC ..... D06P 5/30; A41D 31/125; B41M 5/0041; D06M 16/00; D06Q 1/00
See application file for complete search history.

(56) References Cited

U.S. PATENT DOCUMENTS

2003/0019009 A1 1/2003 Feduzi et al.
2006/0179539 A1 8/2006 Harbcr
(Continued)

FOREIGN PATENT DOCUMENTS

CN 203692637 7/2014
CN 104379028 2/2015
(Continued)

OTHER PUBLICATIONS

Supplementary European Search Report and the European Search Opinion Dated Nov. 6, 2023 From the European Patent Office Re. Application No. 20874664.4. (12 Pages).
(Continued)

*Primary Examiner* — Shelby L Fidler
*Assistant Examiner* — Tracey M Mcmillion

(57) ABSTRACT

A method of printing a garment, particularly for use in sport and outdoor activities, to retain moisture wicking or heat management properties of an underlying fabric. The method comprises mapping active body regions onto a print file for the garment. Thus the print file defines standard print areas and modified print areas where the modified printing areas correspond to the active body regions. Printing onto the garment over the standard print areas uses a standard ink density, but printing onto the garment at the active areas uses a second lower ink density which preserves, or at least does less harm to, wicking and venting properties of the underlying fabric.

3 Claims, 5 Drawing Sheets

(56) References Cited

U.S. PATENT DOCUMENTS

| | | | | |
|---|---|---|---|---|
| 2008/0179562 | A1 | 7/2008 | Quincy | |
| 2011/0099680 | A1 | 5/2011 | Gordon | |
| 2017/0071268 | A1 | 3/2017 | Pan et al. | |
| 2017/0087924 | A1 | 3/2017 | Aihara et al. | |
| 2018/0271184 | A1* | 9/2018 | Shalev | A41D 31/14 |
| 2018/0279696 | A1 | 10/2018 | Navarro et al. | |
| 2019/0309450 | A1 | 10/2019 | Gretton et al. | |
| 2019/0366675 | A1 | 12/2019 | Atkinson et al. | |
| 2020/0129658 | A1* | 4/2020 | Maldonado | A61L 15/42 |

FOREIGN PATENT DOCUMENTS

| | | |
|---|---|---|
| CN | 204146408 | 2/2015 |
| CN | 106820301 | 6/2017 |
| CN | 206603274 | 11/2017 |
| KR | 10-2006-0120834 | 11/2006 |
| WO | WO 2012/096921 | 7/2012 |
| WO | WO 2019/089758 | 5/2019 |
| WO | WO 2021/070179 | 4/2021 |

OTHER PUBLICATIONS

Supplementary Partial European Search Report and the European Provisional Opinion Dated Jul. 27, 2023 From the European Patent Office Re. Application No. 20874664.4. (13 Pages).

International Preliminary Report on Patentability Dated Apr. 21, 2022 From the International Bureau of WIPO Re. Application No. PCT/IL2020/051080. (9 Pages).

International Search Report and the Written Opinion Dated Dec. 7, 2020 From the International Searching Authority Re. Application No. PCT/IL2020/051080. (15 Pages).

Notification of Office Action and Search Report Dated Dec. 14, 2023 From the State Intellectual Property Office of the People's Republic of China Re. Application No. 202080082659.X and Its Machine Translation of Office Action Into English. (20 Pages).

English Summary Dated Dec. 25, 2023 of Notification of Office Action and Search Report Dated Dec. 14, 2023 From the State Intellectual Property Office of the People's Republic of China Re. Application No. 202080082659.X (2 Pages).

Communication Pursuant to Article 94(3) EPC Dated Jul. 25, 2024 From the European Patent Office Re. Application No. 20874664.4. (3 Pages).

* cited by examiner

Fig. 1 Mesh fabrics
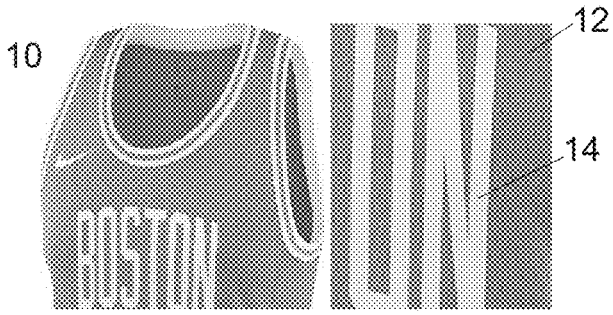
Fig. 2 Wicking
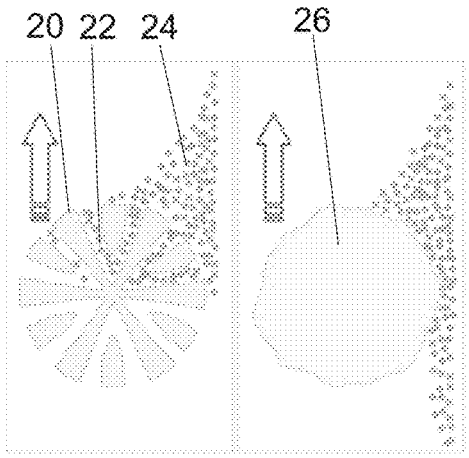
Fig. 3A Body zones
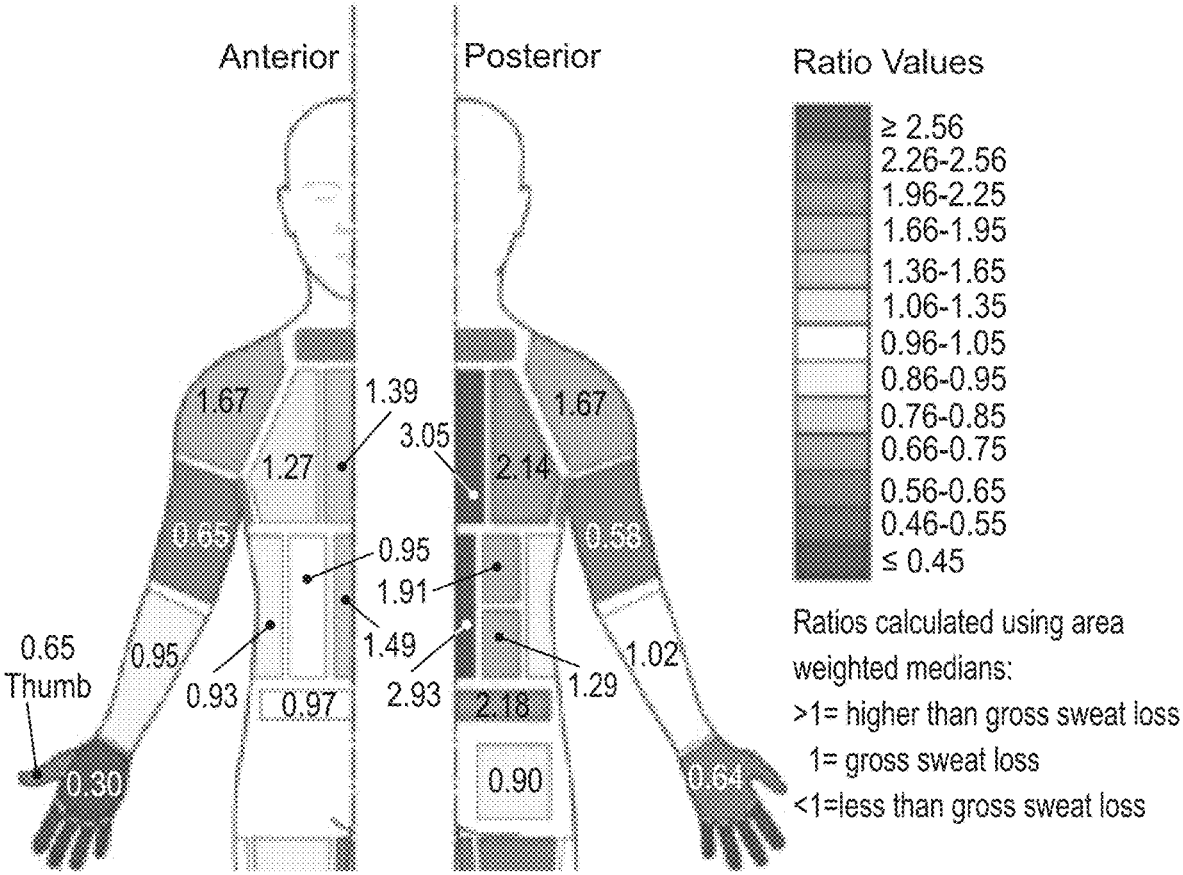

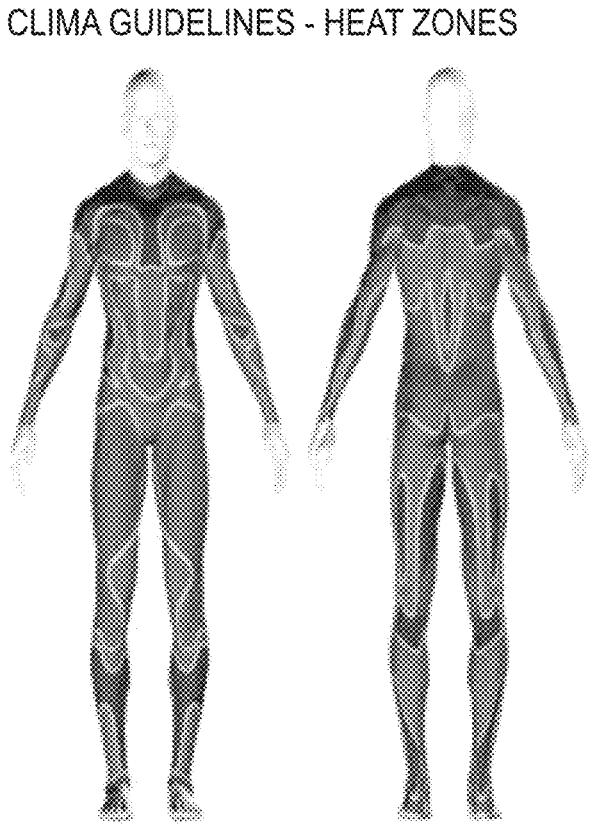
Fig. 3B Heat zones
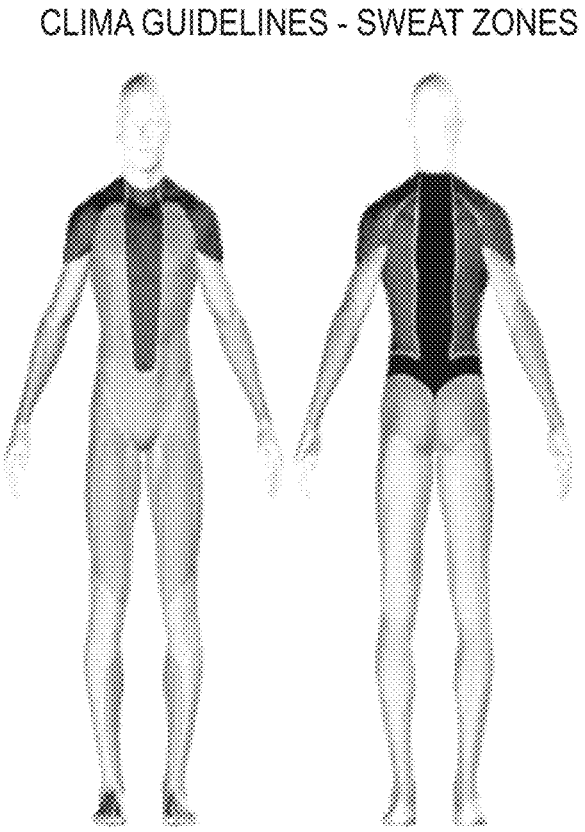
Fig. 3C sweat zones

PRESERVATION OF MOISTURE EVAPORATION AND BODY TEMPERATURE REGULATION PROPERTIES ON GARMENTS POST PRINTING

RELATED APPLICATIONS

This application is a National Phase of PCT Patent Application No. PCT/IL2020/051080 having International filing date of Oct. 6, 2020, which claims the benefit of priority under 35 USC § 119(e) of U.S. Provisional Patent Application No. 62/911,411 filed on Oct. 7, 2019. The contents of the above applications are all incorporated by reference as if fully set forth herein in their entirety.

FIELD AND BACKGROUND OF THE INVENTION

The present invention, in some embodiments thereof, relates to a method for preserving body moisture evaporation and temperature regulation properties on garments post printing, and, more particularly, but not exclusively, to printing on fabrics in a way that does not interfere with the fabric's ability to help with moisture evaporation and temperature regulation.

Body temperature regulation and management of body moisture or sweat is desirable in sports garments particularly tight garments, but also in loose garments.

For this purpose, fabrics such as moisture-wicking fabrics are used. Such fabrics have two tasks: one is quickly moving or wicking sweat to the fabric's outer surface and the other is to dry rapidly so that the sweat does not saturate the fabric. The result is a wearer who is more comfortable because the body can regulate its temperature efficiently and the fabric touching the skin has a dry and non-sticky feel.

However, garments are often printed on before being sold, and the printed garments lose some of their moisture wicking properties. Sports garments are almost exclusively printed on, so much so that the concept of a non-printed sports garment is almost considered not commercially viable. But printing often negates advantages from the fabric being used.

In particular, when printing on breathable and textured garments the printed layer tends to block openings in the mesh and/or destroys the microstructure that allows for the wicking process. The result is a negative affect on the breathing capability of the printed garment.

The ink used in image printing on garments, may further include extra ink layers intended to prevent dye migration in the printing (curing) process, and these extra layers go even further in interfering with wicking, breathing, moisture regulation etc.

Overall, the garment may have mesh, typically in loose garments and the ink and especially the extra layers may block the holes in the mesh. An example is shown in FIG. 1 in which garment 10 has mesh holes 12. In the enlargement the mesh holes under the lettering 14 are shown to have been blocked by the ink.

FIG. 2 shows a fiber 20 with microstructure 22 that takes up sweat particles 24. Fiber 26 has been printed on and the ink has blocked the microstructure, so that the sweat particles are no longer taken up. The capillary action through the microstructure which enables sweat and/or other liquid such as water to have movement through the fabric resulting in regulated body temperature, is terminated. More particularly, the capillaries enable evaporation and heat regulation is a result thereof. Specifically, as a result of ink blocking the microstructure, the Moisture management and cooling quality of the fabric ceases. Wicking is often applied on tight garments.

It would be desirable to find a way of allowing the moisture and body heat regulation of the moisture wicking or mesh fabric to be retained in a printed garment.

SUMMARY OF THE INVENTION

The present embodiments involve mapping out regions of the garment that correspond to high temperature or high sweat areas of the body and diluting the amount of ink printed onto such regions. Alternatively, special ink that is designed to prevent bad smells and/or microbial effects and/or bacterial effects may be printed in the identified regions. Such inks may be relatively expensive and thus it is desirable to limit their use to where they can be most effective.

According to an aspect of some embodiments of the present invention there is provided a method of printing a garment to retain moisture and liquid wicking or heat management properties of an underlying fabric, the method comprising:

- mapping active body regions onto a print file for the garment, to provide a print file defining standard print areas on said garment and modified print areas wherein the modified printing areas correspond to said active body regions;
- printing onto said garment over said standard print areas using a first ink density; and
- printing onto said garment at active areas with a second ink density, said second ink density being different from said first ink density.

In an embodiment, a difference between said first ink density and said second ink density is achieved by printing a different number of pixels.

Alternatively or additionally, a difference between said first ink density and said second ink density is achieved by printing a different amount of ink per pixel.

Alternatively or additionally, a difference between said first ink density and said second ink density is achieved by printing and non-printing of under-layers.

In an embodiment, said active body region is a region of the body producing an above-average amount of heat.

Alternatively or additionally, said active body region is a region of the body producing an above-average amount of sweat.

In an embodiment, said mapping active body regions onto a print file comprises carrying out a pixel by pixel concatenation of a print file for a garment with a map of active body regions.

In an embodiment, said second ink density is lower than said first ink density.

In a second aspect of the present invention there is provided the use of a print map for printing on a garment, the print map comprising pixels, some of the pixels being marked as active body regions, the use comprising printing using a first printing density for printing at said marked pixels and using a second print density for printing at unmarked pixels.

Likewise there is provided a printer programmed to print differentially according to such a print map.

According to a third aspect of the present invention there is provided a garment printed with an image, the garment having at least one active body region and at least one other region, the image having a first ink density in said active body region and a second ink density in said other region.

In the garment, said first ink density may comprise a different density of printed pixels than said second ink density.

Alternatively or additionally, said first ink density comprises a different amount of ink per pixel than said second ink density.

Alternatively or additionally, said first and second ink densities comprise different concentrations of ink respectively or different numbers of printed layers.

In the garment, said active body region may be a region of the garment corresponding to a region of the body of a wearer of the garment which region produces an above-average amount of heat.

In an embodiment of such a garment, said active body region is a region of the garment corresponding to a region of the body of a wearer of the garment, which region produces an above-average amount of sweat.

In such a garment, the first ink density may be greater than said second ink density, or alternatively, said first ink density is less than said second ink density.

The garment may comprise an anti-smell or anti-microbial or anti-bacterial ink printed onto said active region.

According to a fourth aspect of the present invention there is provided a garment printed with an image, the garment having at least one active body region and at least one other region, and comprising at least one of an anti-smell or anti-bacterial ink printed onto said active region.

According to a fifth aspect of the present invention there is provided a method of printing a garment to retain moisture and liquid wicking or heat management properties of an underlying fabric, the method comprising:

- mapping active body regions onto a print file for the garment, to provide a print file defining standard print areas on said garment and modified print areas wherein the modified printing areas correspond to said active body regions;
- printing said image onto said garment over said standard print areas using coloring inks; and
- printing said image onto said garment at active areas using coloring inks and at least one additional ink, said additional ink being an anti-microbial ink or an anti-bacterial ink or an anti-smell ink.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of mapping out printing to dilute ink in the high temperature and high sweat regions of the body according to embodiments of the invention may involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 1 is a simplified diagram illustrating a sports garment with a mesh fabric and showing how printing inks may block the mesh;

FIG. 2 is a simplified diagram showing how sweat is taken up by a fiber having microstructure but is not taken up where the microstructure is blocked by ink or where there is no microstructure at all;

FIG. 3A is a simplified diagram showing front and back views of an upper torso with heat and sweat zones mapped, where the heat and sweat zones combined form active body regions;

FIG. 3B is a simplified diagram showing heat zones mapped to a full body;

FIG. 3C is a simplified diagram showing sweat zones mapped to a full body;

DESCRIPTION OF SPECIFIC EMBODIMENTS OF THE INVENTION

Figure 4:
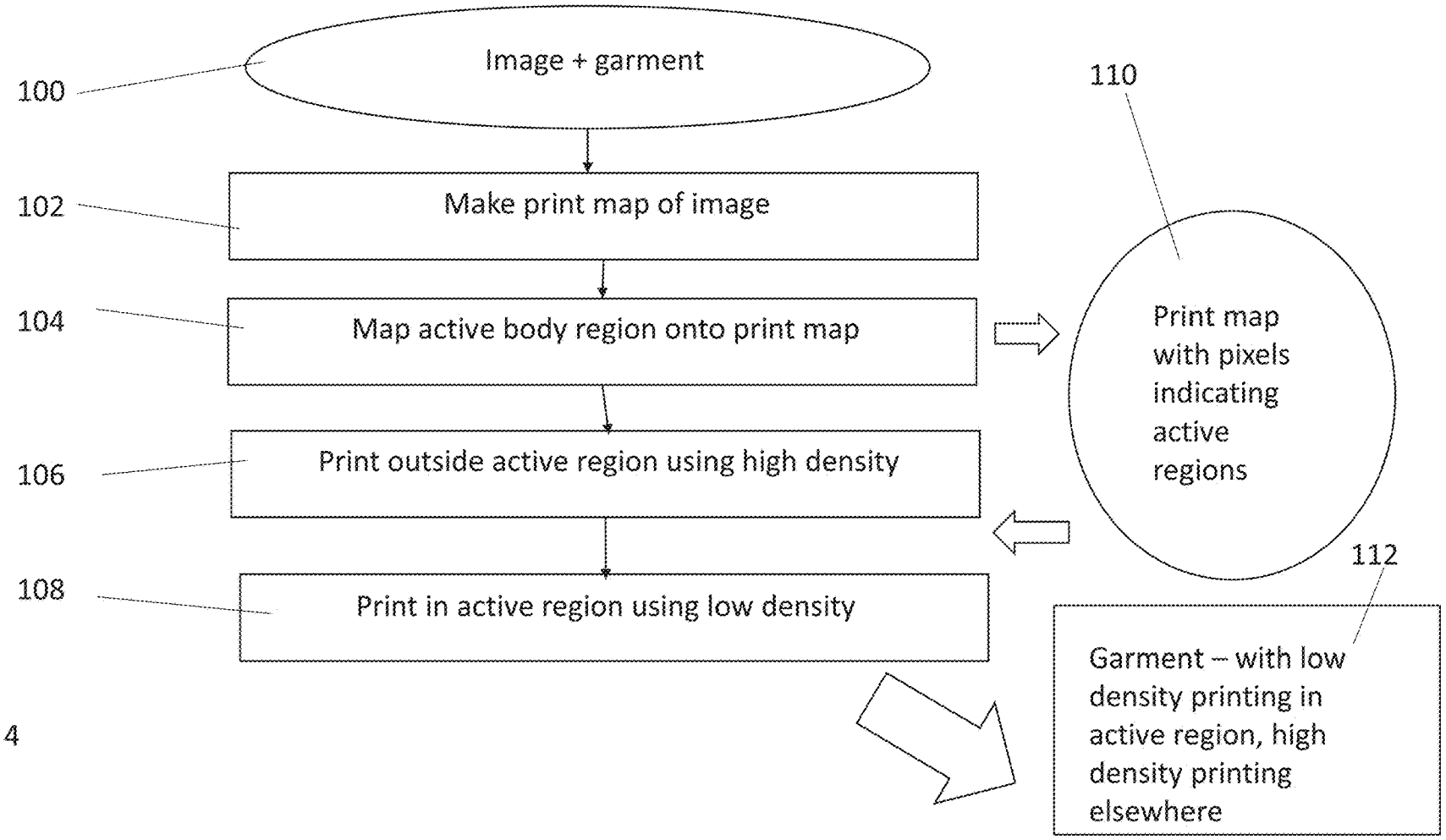
FIG. 4 is a simplified flow chart showing a method for printing an image onto a garment taking into account active body zones according to embodiments of the present invention.

The present invention, in some embodiments thereof, relates to a method for preserving body moisture and temperature regulation properties on garments post printing, and, more particularly, but not exclusively, to printing on fabrics in a way that does not interfere with the fabric's ability to help with moisture and temperature regulation. Additionally or alternatively, embodiments may use the same mapping in order to print anti-microbial or anti-bacterial or anti-smell inks in the identified areas. It is further noted that the present method is not restricted to printing on the final garment but may also be applied to textile printing in the roll to roll process where the garment fabric is printed and then cut into a ready garment. The latter may be carried out as long as there is coordination between the printing and the cutting so that the areas identified as heat or sweat areas for printing in fact turn out to be so after cutting.

To overcome the problem of blocking holes on Mesh garments and damaging wicking and venting properties of the textile, when printing over out-door and athletic garments the present embodiments may, as will be explained below, provide a method for preserving original fabric qualities following printing of an image on the garment. The qualities to be preserved include: a dry feel of the fabric, temperature regulation and non-stick feel, and when adding anti-microbial or anti-bacterial inks preventing bad smell and microbial grows in these areas.

The present embodiments thus provide a method of printing a garment, particularly for use in sport and outdoor activities, to retain moisture wicking or heat management properties of an underlying fabric. The method comprises mapping active body regions onto a print file for the garment. Thus the print file defines standard print areas and modified print areas where the modified printing areas correspond to the active body regions, or print in these areas the anti-microbial or anti-bacterial inks. Printing onto the garment over the standard print areas uses a standard ink density, but printing onto the garment at the active areas uses a second lower ink density which preserves, or at least does less harm to, wicking and venting properties of the underlying fabric.

The embodiments further relate to a garment printed with different ink densities for active and passive regions where the active regions correspond to hot and sweat producing regions on the body as the garment is worn in the normal way.

Herein, the term "garment" is used for anything that is normally worn. Reference to corresponding body areas relates to the way in which the garment is normally worn and is intended to be worn. Particular emphasis is laid on garments worn for sports and outdoor activities, including underwear and outerwear, and including running vests, shorts, trousers, shirts, swim suits, jackets, coats, and more generally anything that is intended for wearing and is printed on.

Herein the term "mapping" relates to transferring data having a geometric dimension from one domain to another. Thus data relating to body regions is held on one map of the body, and an image to be printed is held in an image file that relates the data to locations on a garment. Mapping refers to the process of transferring body regions onto the image to be printed so that a new file is created having image data that is distinguished according to body regions.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

As explained in the background, a feature of fabrics used for sports garments and garments intended for outdoor activities in general is moisture-wicking. Such fabrics may use microfibers for wicking sweat using capillary action to draw away sweat from the body and allow the sweat to spread out and evaporate easily. These or other fabrics may include mesh or pores which allow the skin to breath and give the user a feeling of ventilation. It is noted that heat regulation may be a result of windchill, that is the lowering of body temperature due to the flow of lower-temperature air. In particular, a surface loses heat through conduction, evaporation, convection, and radiation. The rate of convection depends on both the difference in temperature between the surface and the fluid surrounding it and the velocity of that fluid with respect to the surface. As convection from a warm surface heats the air around it, an insulating boundary layer of warm air forms against the surface. Moving air disrupts this boundary layer, or epiclimate, allowing for cooler air to replace the warm air against the surface. The faster the wind speed, the more readily the surface cools. As discussed above, printing inks may block wicking channels and close up mesh or pores as discussed, causing the fiber to lose the unique sports-friendly qualities post printing. The present embodiments are intended to mitigate the effect of the ink, as discussed above in respect of FIGS. 1 and 2, on the specialized fibers and retain the sports-friendly qualities originally intended for the garment. One solution involves diluting ink quantity/CM2 based on color matching and/or zones as indicated in FIGS. 3A-3C. The zones indicated in FIGS. 3A-3C are those that are more heat and sweat sensitive, and the use of reduced ink density may reduce the capillarity action degradation and avoid blocking pores and thus preserve the original qualities of the fabric. Thus the sports garment may continue to meet its original specification of remaining dry, assisting the sports person with temperature regulation and having a cool and non-stick feel.

The present embodiment may be used for fabrics, and garments using those fabrics, which have native qualities including heat regulation/preservation and giving a feel of cooling and warming, by allowing for moisture wicking etc., particularly in those parts of the garment that face active areas of the body, meaning areas that are hotter or produce more sweat.

In one embodiment it is possible to use the mapping to print special anti-smell or anti-microbial or anti-bacterial inks to prevent microbial or bacterial grows and bad smell.

In one embodiment, it is possible to preserve and protect these native qualities by printing using reduced image-thickness and density when over a targeted Active-area.

The active area may already be designed into the garment and may have low fabric density, or a higher density of capillary-micro-fiber for enhanced moisture wicking etc.

A printer using the present embodiments may thus print the image on the active areas with less ink/cm based on lower/higher print resolution, variable droplet size (gray-scale) etc. or fewer underlayers and the printing thus manages to preserve the built-in fabric qualities, or at least to degrade the properties to a lesser extent.

The present embodiments may define the active areas based on previous knowledge, for example using the heat & sweat zones map shown in FIGS. 3A-3C, or using vendors data etc. when the garment is explicitly designed with active areas in mind, or actually carrying out trials with detection apparatus etc.

As well as defining active areas for sweating and heat management, similar mapping techniques may be used to print garments with special ink that may help with other effects, for example, garments may be printed with antimicrobial inks, or anti-bacterial inks or anti-staining inks etc.

Referring now to FIG. 4, there is shown a simplified flow chart illustrating printing on a garment, such as a garment specifically for sport or outdoor activities, in such a way as to retain moisture wicking or heat management properties of the underlying fabric. The garment and the image it is intended to print are obtained 100. The image is typically in the form of a digital image file, or may be scanned to form a digital image file. In box 102 the image file is transformed into a print file, which is the same as the image file except that image parameters are modified for the printer. Thus the image file may use the RGB color mapping scheme whereas the print map may use the CMYK color coordinate system. The image file may use pixel sizes and resolutions intended for screen formats whereas the print file may use pixel sizes that correspond to the print nozzles of the printer and the resolution that the printer is able to achieve.

In box 104 an active body region, that is a region that produces excess heat or excess sweat, is mapped onto the print file and pixels that correspond to the active regions are marked. In fact the mapping may alternatively be made at the stage of the image file, as long as the pixel information is retained during the conversion to a print file. Mapping active body regions onto a print file may be involve carrying out a pixel by pixel concatenation of the print file for a garment with a map of the active body regions.

The print file now contains two types of pixels, those identified as belonging to an active region and those identified as not belonging to an active region. The print file thus defines standard print areas on the garment and modified print areas that correspond to the active body regions. In boxes 106 and 108, the active body regions are then printed at a lower ink density than the standard regions. Thus, printing onto the garment over the standard print areas uses a first ink density which is typically the standard density produced by the print file for the given color and brightness etc., and the active areas are printed with a second ink density which is lower than the first ink density. The lower ink density may be achieved by printing fewer pixels in the region, or by printing less ink per pixel, or by not printing under-layers, or even by diluting of ink.

As discussed, the active body region is a region of the body producing an above-average amount of heat, as shown in FIG. 3B, together with a region of the body producing an above-average amount of sweat as shown in FIG. 3C.

A print map, 110, which contains pixels marked as belonging to active regions may thus be used for printing a garment, in that the print map is used to print using a lower printing density for printing at the pixels in the active region and using a second print density for printing at unmarked pixels. The active region may accord with a body map of heat or sweat producing regions.

A garment 112 may thus be printed with an image so that parts belonging to the active body region have a lower ink density and the remainder of the garment has a higher ink density.

In another embodiment of the present invention, it is possible to make a garment designed for heat retention. The heat map of the body is used to define regions which can be printed more heavily in order to retain heat in the body.

Figure 5:
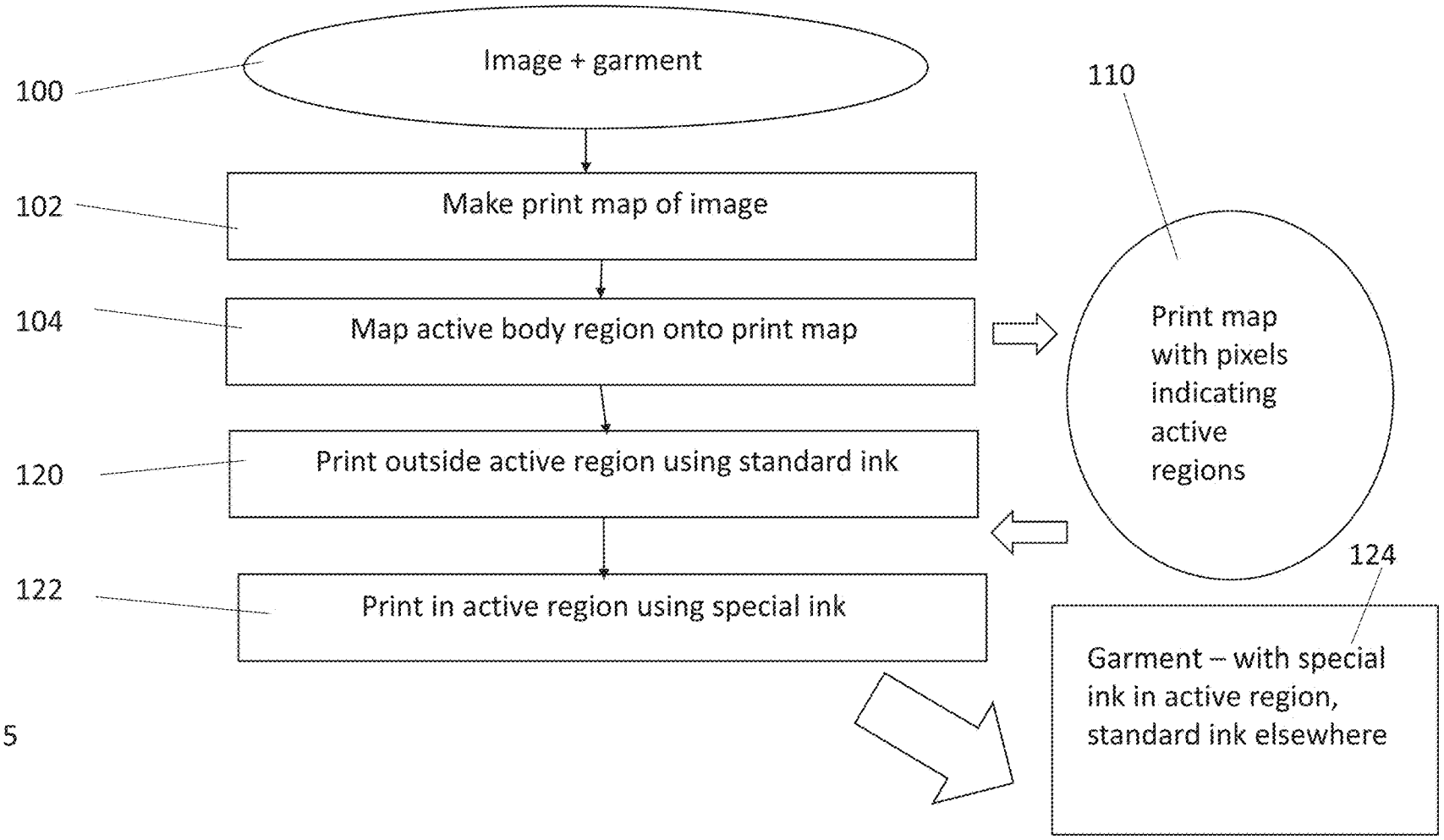
FIG. 5 is a variation of the embodiment of FIG. 4 in which anti-smell or anti-bacterial inks are used in the active body zone or region.

Reference is now made to FIG. 5, which is a flow chart illustrating the use of special inks. Boxes 100, 102 and 104 are as discussed above, and the print map 110 may be the same. In box 120, printing is carried out outside the active region using standard ink, and in box 122, specialized ink is added to the color ink inside the active region. Garment 124 is the end result.

Figure 6:
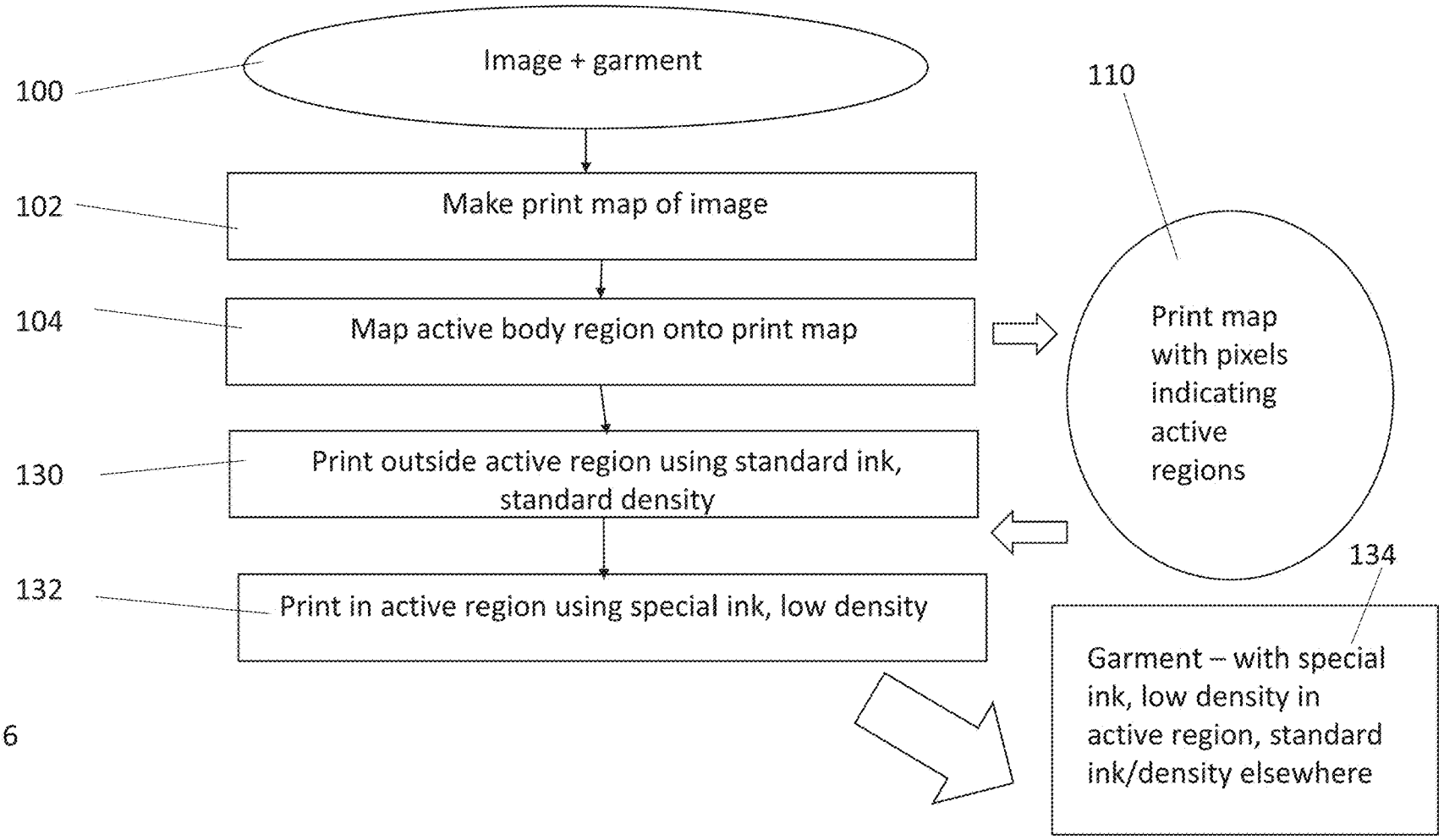
FIG. 6 is a variation that combines the embodiments of FIG. 4 and FIG. 5.

Reference is now made to FIG. 6, which illustrates an embodiment in which the two approaches are combined. Again, boxes 100, 102 and 104 are as discussed above, and the print map 110 may be the same. In box 130, printing is carried out outside the active region using standard ink and standard ink density, and in box 132, specialized ink is added to the color ink inside the active region which is printed at a lower density. Garment 134 is the end result.

It is noted that printing may be carried out directly on a garment or it may be applied to the fabric before it has been cut into a garment, in particular if the printing and cutting are coordinated so that the printer is able to print on the regions that will later be the active regions when cut. The claims herein are to be understood accordingly. It is expected that during the life of a patent maturing from this application many relevant garment printing inks including specialist inks, specialist textiles for heat and sweat management, and textile printing machines will be developed and the scopes of the corresponding terms are intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated by reference in its/their entirety.

What is claimed is:

1. A method of printing a garment to retain moisture and liquid wicking or heat management properties of an underlying fabric, the method comprising:

mapping active body regions onto a print file for the garment, to provide a print file defining standard print areas on said garment and modified print areas wherein the modified printing areas correspond to said active body regions;

printing image material onto said garment over said standard print areas using coloring inks; and printing further image material onto said garment at active areas using said coloring inks but said printing of said coloring inks at said active areas being modified to retain said moisture and liquid wicking properties of said underlying fabric and, additionally to said further image material, printing on said active areas at least one additional ink, said additional ink being an anti-microbial ink or an anti-bacterial ink or an anti-smell ink.

2. The method of claim 1, wherein said mapping active body regions onto a print file comprises carrying out a pixel by pixel concatenation of a print file for a garment with a map of active body regions.

3. A method of printing a garment to retain moisture and liquid wicking or heat management properties of an underlying fabric, the method comprising:

mapping active body regions onto a print file for the garment, to provide a print file defining standard print areas on said garment and modified print areas wherein the modified printing areas correspond to said active body regions;

printing image material onto said garment over said standard print areas using coloring inks; and printing further image material onto said garment at active areas using said coloring inks but said printing of said coloring inks at said active areas being modified to retain said moisture and liquid wicking properties of said underlying fabric and, additionally to said further image material, printing on said active areas at least one additional ink, said additional ink being an anti-smell ink.

* * * * *